US008720498B2

(12) United States Patent
Martin

(10) Patent No.: US 8,720,498 B2
(45) Date of Patent: May 13, 2014

(54) REMOTE FILL HEAD WITH AUTOMATIC DRIP TRAY

(75) Inventor: Richard W. Martin, Laurel, MD (US)

(73) Assignee: EnergySolutions, LLC, Salt Lake City, UT (US)

( * ) Notice: Subject to any disclaimer, the term of this patent is extended or adjusted under 35 U.S.C. 154(b) by 1034 days.

(21) Appl. No.: 11/879,178

(22) Filed: Jul. 16, 2007

(65) Prior Publication Data

US 2009/0020181 A1 Jan. 22, 2009

(51) Int. Cl.
*B65B 39/00* (2006.01)

(52) U.S. Cl.
USPC ..... 141/86; 141/251; 141/233; 141/270; 141/279; 141/283; 141/284; 222/153.02; 222/320

(58) Field of Classification Search
USPC ..... 141/86, 87, 88, 284, 251, 263, 233, 141/270, 279, 283; 222/153.03, 153.02, 222/320; 414/146, 199, 419
See application file for complete search history.

(56) References Cited

U.S. PATENT DOCUMENTS

| | | | | |
|---|---|---|---|---|
| 1,050,254 | A * | 1/1913 | Thwaites | 110/118 |
| 2,792,855 | A | 5/1957 | Walts | |
| 2,874,733 | A | 2/1959 | Sesler et al. | |
| 3,418,019 | A * | 12/1968 | Fadler | 294/68.24 |
| 3,677,328 | A | 7/1972 | Buzzi et al. | |
| 3,831,644 | A | 8/1974 | Berg et al. | |
| 3,948,723 | A | 4/1976 | Andrea et al. | |
| 3,971,485 | A | 7/1976 | Hoppey | |
| 3,971,732 | A | 7/1976 | Meier | |
| 4,196,169 | A | 4/1980 | Gablin et al. | |
| 4,234,447 | A | 11/1980 | Hay, II et al. | |
| 4,439,403 | A | 3/1984 | Brunner et al. | |
| 4,469,148 | A * | 9/1984 | Vogele et al. | 141/87 |
| 4,526,215 | A * | 7/1985 | Harrison et al. | 141/83 |
| 4,528,796 | A * | 7/1985 | Lemaire | 53/268 |
| 4,588,350 | A | 5/1986 | Iwamoto | |
| 4,624,042 | A | 11/1986 | Green | |
| 4,636,363 | A | 1/1987 | Kratz et al. | |
| 4,708,571 | A * | 11/1987 | Sappok | 414/412 |
| 4,932,445 | A * | 6/1990 | Biehl | 141/83 |

(Continued)

FOREIGN PATENT DOCUMENTS

DE 9209178 U1 10/1992

OTHER PUBLICATIONS

European Search Report for International Application No. 08835299.2, mailed Jan. 7, 2014 (9 pp).

*Primary Examiner* — Jason Boeckmann
*Assistant Examiner* — Joel Zhou
(74) *Attorney, Agent, or Firm* — Holland & Hart

(57) ABSTRACT

A fill head for depositing hazardous waste materials into a container movable between a filling position seated on the container, and a container exchange position withdrawn from the container; a control arm carried by the fill head directing movement of the fill head between the filling and exchange positions; a drip tray movably carried on a support platform adjacent the fill head for extending underneath the fill head to retain drippings of the hazardous waste material from the fill head when in the exchange position; and, a lifting arm carried by the drip tray engaging the control arm, wherein the lifting arm biases the control arm to raise the fill head from the filling position to the exchange position when the drip tray is extended underneath the fill head so that as the fill head is withdrawn from the container any dripping hazardous waste is captured by the drip tray.

18 Claims, 7 Drawing Sheets

(56) References Cited

U.S. PATENT DOCUMENTS

| | | | | | |
|---|---|---|---|---|---|
| 4,957,147 | A | | 9/1990 | Lowe | |
| 4,967,812 | A | * | 11/1990 | Herzog | 141/88 |
| 5,020,963 | A | | 6/1991 | Okada | |
| 5,378,410 | A | | 1/1995 | Erbse et al. | |
| 5,566,727 | A | | 10/1996 | Erbse et al. | |
| 6,053,219 | A | | 4/2000 | Seiver | |
| 6,666,003 | B1 | | 12/2003 | Allais et al. | |
| 2006/0254887 | A1 | * | 11/2006 | Aubry et al. | 198/860.3 |

* cited by examiner

REMOTE FILL HEAD WITH AUTOMATIC DRIP TRAY

FIELD OF THE INVENTION

This invention is directed to a system for encapsulating hazardous materials such as radioactive waste and other wastes in a container, and more specifically to an automated fill head having a drip control unit that raise and loser the fill head to the container and retains any drippings of hazardous waste materials from the fill head.

BACKGROUND OF THE INVENTION

In several industries, including the nuclear power industry, waste products are generated by normal operations of such facilities. For example, nuclear power plants and hospitals produce waste materials that are bio-hazardous such as wastes that are radioactive. These wastes can include low level radioactive materials that need to be placed in secure containers for disposal. Prior to its disposal, the bio-hazardous materials need to be properly stored in a proper container that can protect individuals from the harmful effects of hazards such as radiation.

One method of storing these waste products is to encapsulate the radioactive waste within a solid matrix in a secure container. This encapsulation process involves in-container mixing of wastes with a wet or dry cement type mixture to form a solid monolith that is stable for long term storage and disposal of the hazardous materials.

Since exposure to these waste materials is harmful to individuals, a shielded automated system is used to fill storage containers and to have the solid monolith formed in the container without direct personal contact. During the process, an automatic engagement solidification fill head is used to assist in performing the following steps: introducing waste into the container; dewatering the waste if necessary; providing preconditioning chemicals if needed; adding binders such as dry cement, wet grout, or others and mixing the entire contents in the container. The contents then cure into a solid monolith thereby trapping the waste materials in a stable matrix for transport and storage.

The process of introducing the waste and binders to the container can be accomplished through what is referred to as a "fill head" that has nozzles for transmitting waste, binders and other materials into the container. Operation of the fill head requires seating the fill head on the container so that waste does not splash out of the container, connecting hoses to the fill head and securing the agitator drive coupling to the fill head. These steps are reversed to remove the fill head once the encapsulation process is completed.

Some wastes, particularly radioactive wastes, are too hazardous for humans to have direct exposure to hands-on operation of a fill head for performing the steps described above. The high level waste simply creates too great a risk for individuals to be operating the equipment by hand. This is particularly true since fill heads drip waste once it is removed from the container. These drippings can result in a buildup of hazardous material in the container filling area that can result in harmful radiation exposure to individuals operating the fill head.

Thus, there is a need in the waste containment industry for an automatic solidification fill head that allows for the encapsulation of harmful wastes without direct human hands-on operation that reduces the dangerous buildup of hazardous materials that may drip from the fill head between filling storage containers.

Accordingly, it is an object of the present invention to provide an automated fill head assembly for loading hazardous waste into containers that includes a drip control unit to retain drippings from the fill head.

SUMMARY OF THE INVENTION

The above objectives are accomplished according to the present invention by providing an automated fill head assembly for loading hazardous waste into containers, said fill head assembly comprising a fill head for depositing hazardous waste materials into a container, wherein said fill head is movable between a filling position seated on the container, and a container exchange position withdrawn from the container; a control arm carried by said fill head directing movement of said fill head between said filling and exchange positions; a drip tray movably carried on a support platform adjacent said fill head for extending underneath said fill head to retain drippings of said hazardous waste material from said fill head when in said exchange position; and, a lifting arm carried by said drip tray engaging said control arm, wherein said lifting arm biases said control arm to raise said fill head from said filling position to said exchange position when said drip tray is extended underneath said fill head so that as the fill head is withdrawn from the container any dripping hazardous waste is captured by said drip tray.

In a further advantageous embodiment, said lifting arm includes a slanted bearing surface for engaging said control arm in sliding engagement to direct said control arm upward as said drip tray is extended underneath said fill head.

In a further advantageous embodiment, said control arm includes a roller for engaging said slanted bearing surface to promote sliding engagement between said lifting arm and said control arm.

In a further advantageous embodiment, said drip tray includes an absorbent pad disposed across at least a portion of said drip tray extended underneath said fill head for capturing drippings.

In a further advantageous embodiment, a drive mechanism is carried on said support platform being operatively connected to said drip tray for moving said drip tray along said support platform between an extended position underneath said fill head when said fill head is moved to said exchange position, and a retracted position withdrawn from said fill head when said fill head is in said filling position.

In a further advantageous embodiment, the drive mechanism includes a drive motor rotationally connected to a drive shaft with a first drive wheel rotatably connected to said drive shaft, and a first guide wheel spaced apart from said first drive wheel on said support platform with a first drive chain rotatably carried by said first drive wheel and said first guide wheel.

In a further advantageous embodiment, said drip tray includes a first drive arm connected to said first drive chain in a fixed position so that rotation of said first drive chain causes said drip tray to move along said support platform between said extended and retracted positions.

In a further advantageous embodiment, said drive shaft includes a second drive wheel with a second guide wheel spaced apart from said second drive wheel and a second drive chain rotatably carried thereon, wherein said drip tray includes a second drive arm connected to said second drive chain disposed on an opposite end of said drip tray from said first drive arm for moving said drip tray along said support platform in cooperation with said first drive chain.

In a further advantageous embodiment, said support platform includes a pair of guide rails being generally parallel and spaced apart from each other for directing movement of said drip tray along said support platform.

In a further advantageous embodiment, said drip tray includes guide rollers carried on said lifting arm for running along guide rails to promote sliding movement of said drip tray along said guide rails.

In a further advantageous embodiment, a secondary catch tray is connected to said drive mechanism being disposed on an opposite end of said support platform from said drip tray, wherein said secondary catch tray is drawn towards said drip tray when said fill head is moved to said exchange position so that said drip tray at least partially overlaps with said secondary catch tray to retain any drippings from said fill head.

In a further advantageous embodiment, said guide rails include an upper track and lower track, wherein said guide rollers carried on said lifting arm run along said upper track, and secondary catch tray includes guide rollers running along said lower track to promote sliding movement of said drip tray and catch tray along said guide rails.

The above objectives are further accomplished according to the present invention by providing a method for controlling drippings from a fill head for hazardous waste materials comprising the steps of lowering said fill head into a filling position seated on a container for depositing hazardous waste materials into the container; loading hazardous waste materials into said container; providing a drip tray adjacent said fill head carrying a lifting arm for engaging said fill head; moving said drip tray towards said fill head to engage said lifting arm with a control arm carried on said fill head so that said lifting arm biases said control arm upwardly and raises said fill head from said filling position on said container to a container exchange position withdrawn from said container; and, extending said drip tray underneath said fill head as said lifting arm raises said fill head to said exchange position to retain any hazardous waste materials dripping from said fill head.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF THE INVENTION

Figure 1:
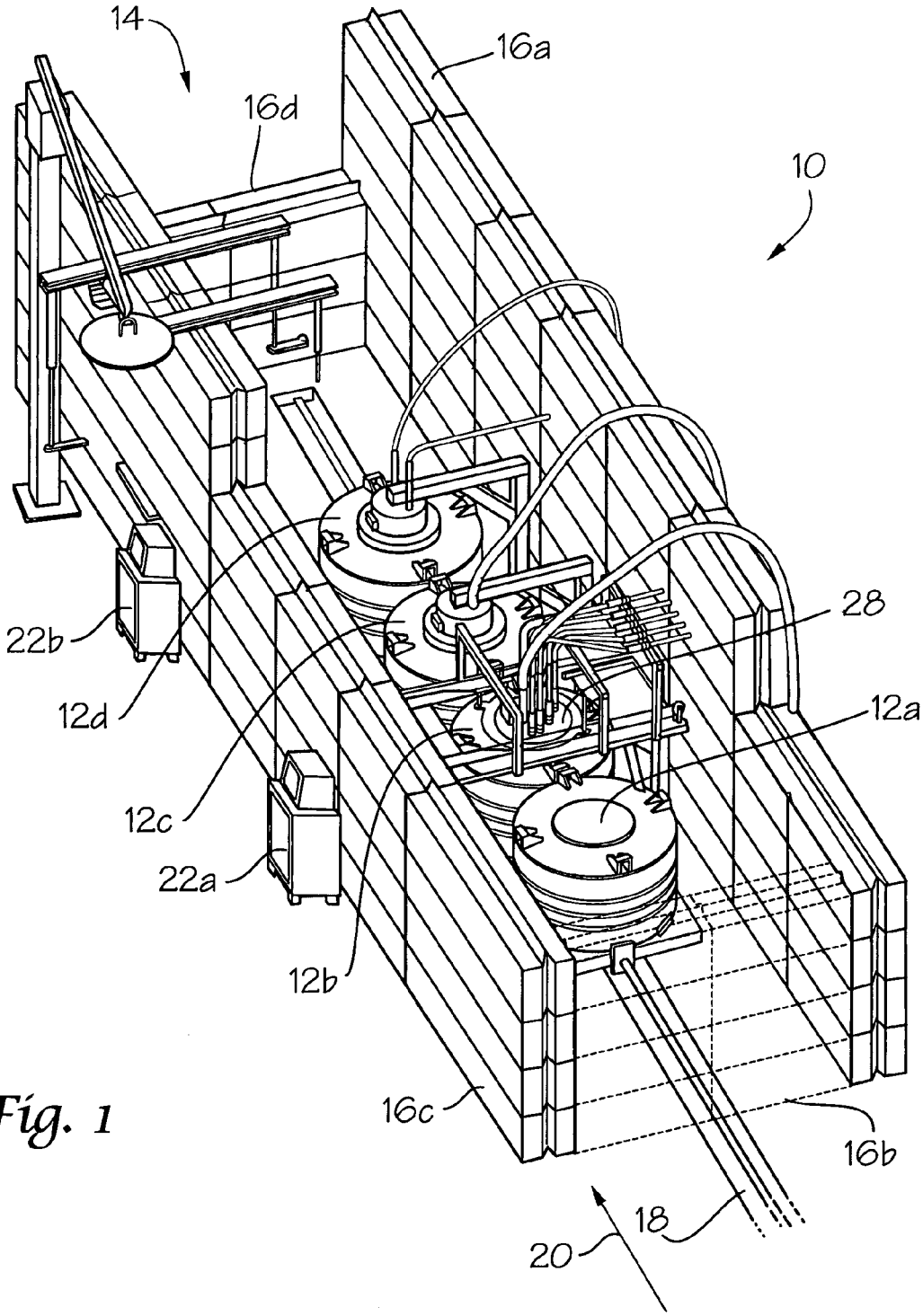
FIG. 1 shows a perspective view of shielded storage container fill head assembly according to the present invention.

With reference to the figures, the invention will now be described in more detail. Referring to FIG. 1, a container filling area is generally shown as 10. Containers 12*a* through 12*d* are shown located within shielded area 14 defined by shielding walls 16*a* through 16*d*. The shielding walls help block the radiation shine path from the shielded area 14.

Figure 2:
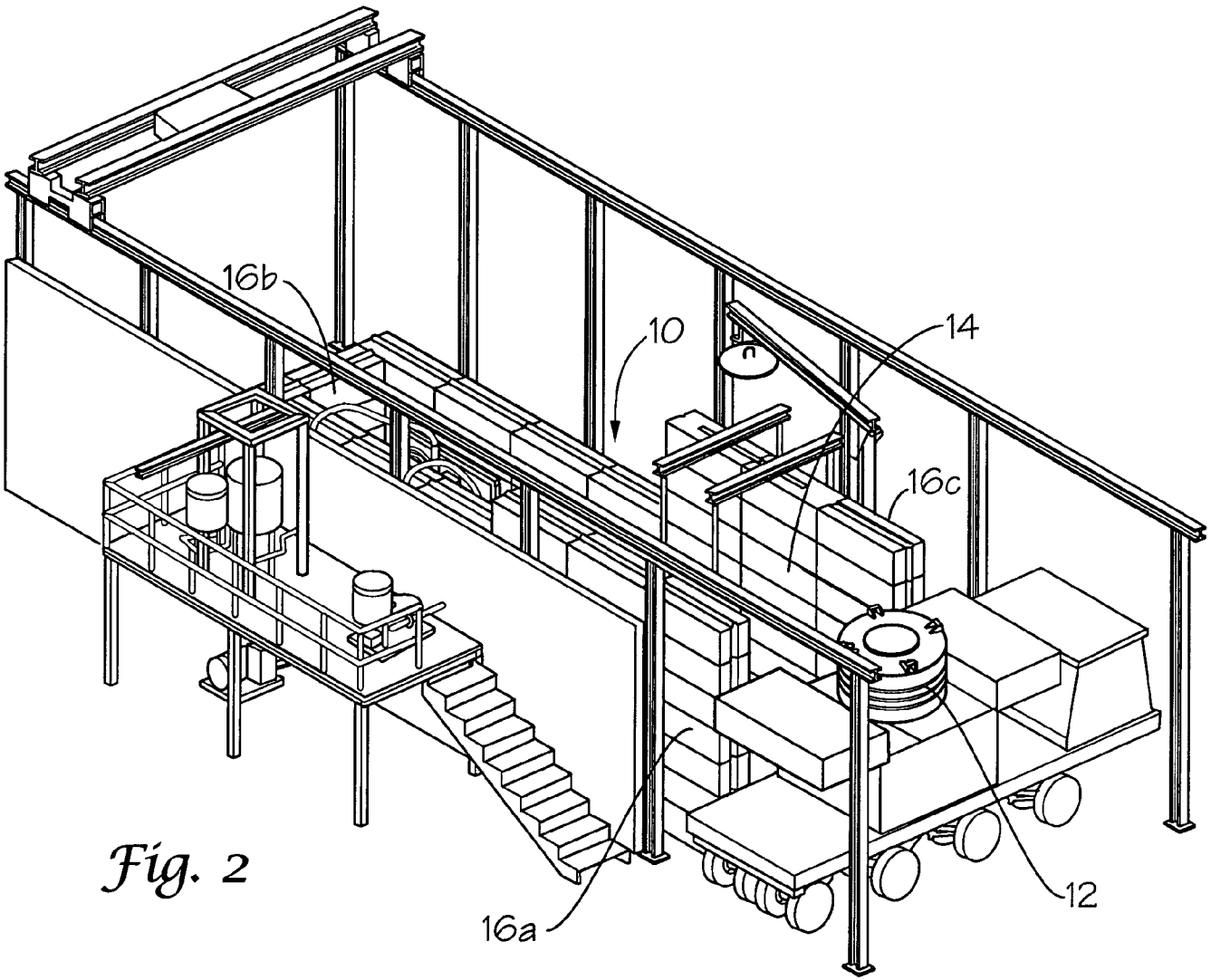
FIG. 2 shows a perspective view of the shielded storage container fill head assembly according to the present invention.

The containers can be placed on a conveyor system which includes a series of rollers and can be guided by track 18 so that the containers can travel generally in a direction shown as 20 where they can be received into the shielded area for filling. Computer terminals 22*a* and 22*b* can be located outside the shielded area and operated by individuals at a safe distance from the hazardous waste material for monitoring and operating the container filling process. As shown in FIG. 2, the containers, once filled, can be removed from the shielded area and transported or stored since the hazardous waste is now secured within the container.

Figure 3:
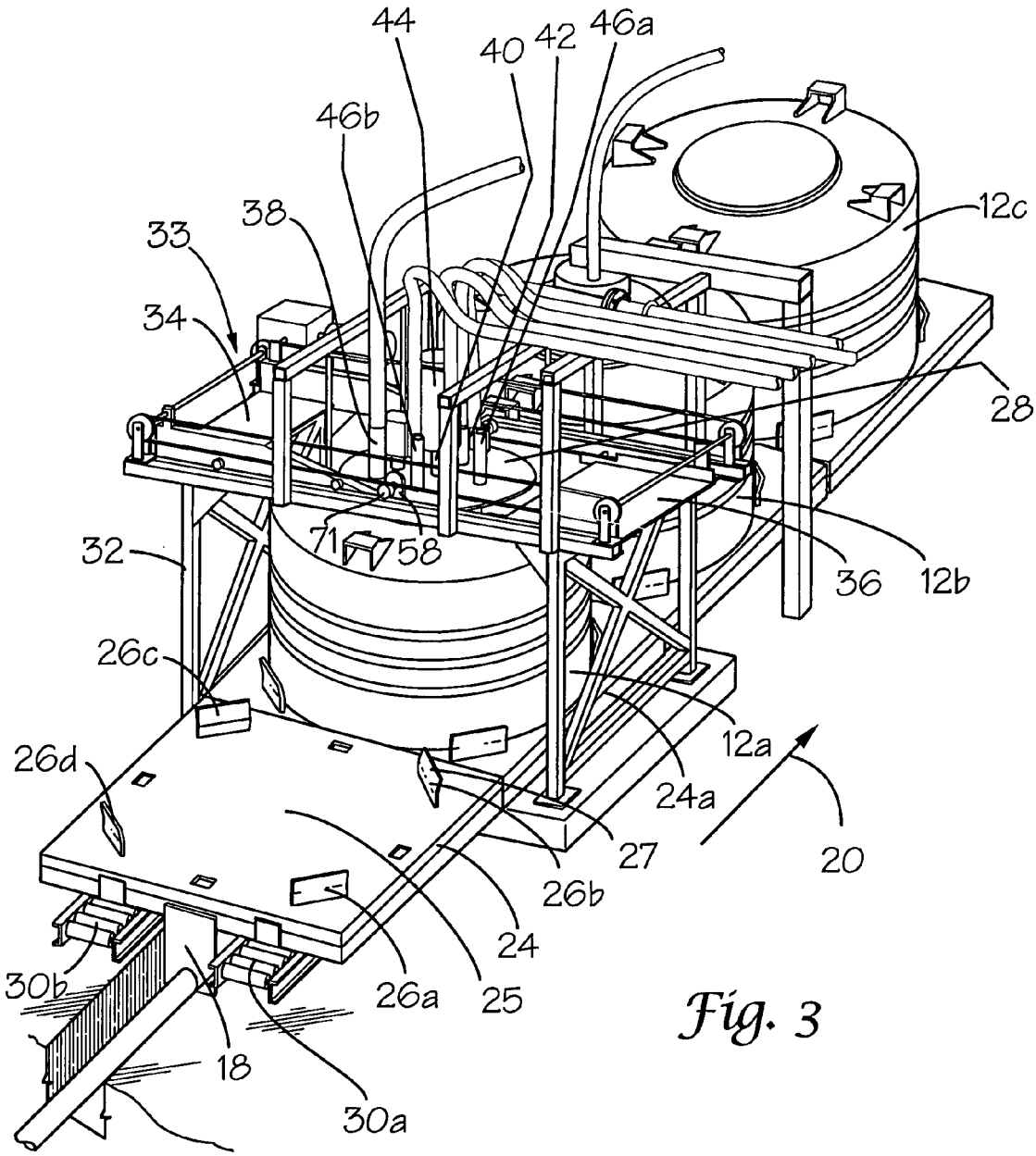
FIG. 3 shows a perspective view of the support platform and fill head assembly receiving pallets carrying storage containers according to the present invention.

Referring to FIG. 3, containers can be placed upon pallet 24 which can have guide plates 26*a*-26*d* to help with placement of containers 12*a*-12*c* onto a container receiving surface 25 on the respective trays. Guide plates 26*a*-26*d* have slanted contact faces 27 that help funnel the containers into proper placement on container receiving face 25 which helps ensure that fill head 28 properly engages the container top during the filing process. Roller sets 30*a* and 30*b* can assist with the transportation of pallets 24 and the containers thereon in a direction shown as 20 for aligning under the fill head assembly 28.

When in operation, container 12*a* travels along the conveyor on pallet 24*a* and is positioned under fill head 28. Fill head 28 is supported by support platform 32 by control arms 58. Support platform 32 also supports a drip control unit, designated generally as 33, adjacent fill head 28 being operatively associated with control arms 58 for actuating movement of control arms 58 to move fill head 28 between a filling position seated on the storage container, and a container exchange position, shown in FIG. 6, withdrawn from the container so that as fill head 28 is withdrawn from the container to the exchange position any dripping hazardous waste is captured.

Waste nozzles 38 can be carried by fill head 28 and used to introduce waste into the container. Binder nozzle 40 can be carried by the fill head and can be used to introduce binders to the container. Pre-treatment nozzle 42 can be carried by fill head 28 and can be used to introduce pre-treatment materials to the container. Agitator 44 can be carried by the fill head and can be used to actuate an agitator (not shown) internal to the container for mixing the materials introduced within the container. Additional nozzles 46*a* and 46*b* can be carried by fill head 28 for introducing other materials into the container for other purposes.

Figure 4:
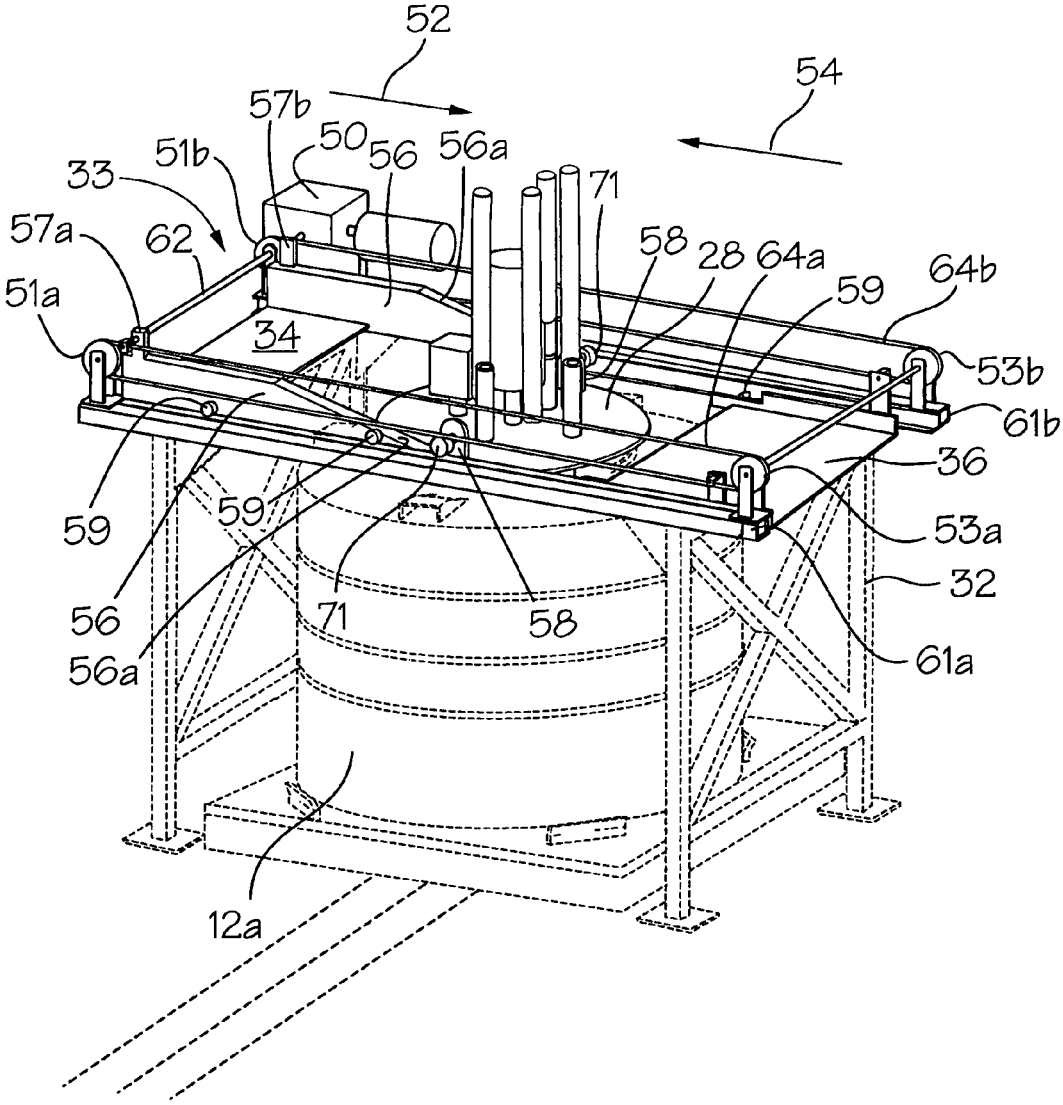
FIG. 4 shows a perspective view of the drip control unit in a retracted position on the support platform with the fill head in a filling position seated on the storage container according to the present invention.

Referring now to FIG. 4, fill head 28 is shown in the fill position seated on the storage container so that waste and other materials can be introduced into the container. Drip control unit 33 includes a drip tray 34 and a secondary catch tray 36 for cooperating with fill head 28 to retain any drips. Drip tray 34 and secondary catch tray 36 are in a retracted position so that fill head 28 is allowed to be in contact with the container for inserting waste materials. In this position, any dripping from the fill head will be received by the container and will not be deposited in the filling area outside of the container.

A pair of lifting arms 56 are carried on each side of drip tray 34 for engaging control arms 58. The lifting arm biases control arms 58 to raise fill head 28 from the filling position to the container exchange position when drip control unit 33 extends drip tray 34 in direction 52 and underneath fill head 28 so that as the fill head is withdrawn from the container any dripping hazardous waste is captured by said drip tray. Lifting arms 56 include a slanted bearing surface 56*a* for engaging control arms 58 in sliding engagement to direct the control arms upward as drip tray 34 is extended underneath fill head 28. Control arms 58 preferably each include a roller 71 for engaging slanted bearing surface 56*a* to promote sliding engagement between lifting arms 56 and control arms 58.

A drive mechanism 50 is carried on said support platform being operatively connected to drip tray 34 for moving the drip tray along the support platform between an extended position underneath the fill head when the fill head is moved to the exchange position, and a retracted position withdrawn from the fill head when the fill head is in the filling position. Drive mechanism 50 can be a motor and gear box connected to a drive shaft 62. The drive motor is rotationally connected to drive shaft 62 with a first drive wheel 51*a* rotatably connected to drive shaft 62, and a first guide wheel 53*a* spaced apart from first drive wheel 51*a* on support platform 32 with a first drive chain 64*a* rotatably carried by first drive wheel 51*a* and first guide wheel 53*a*.

Figure 6:
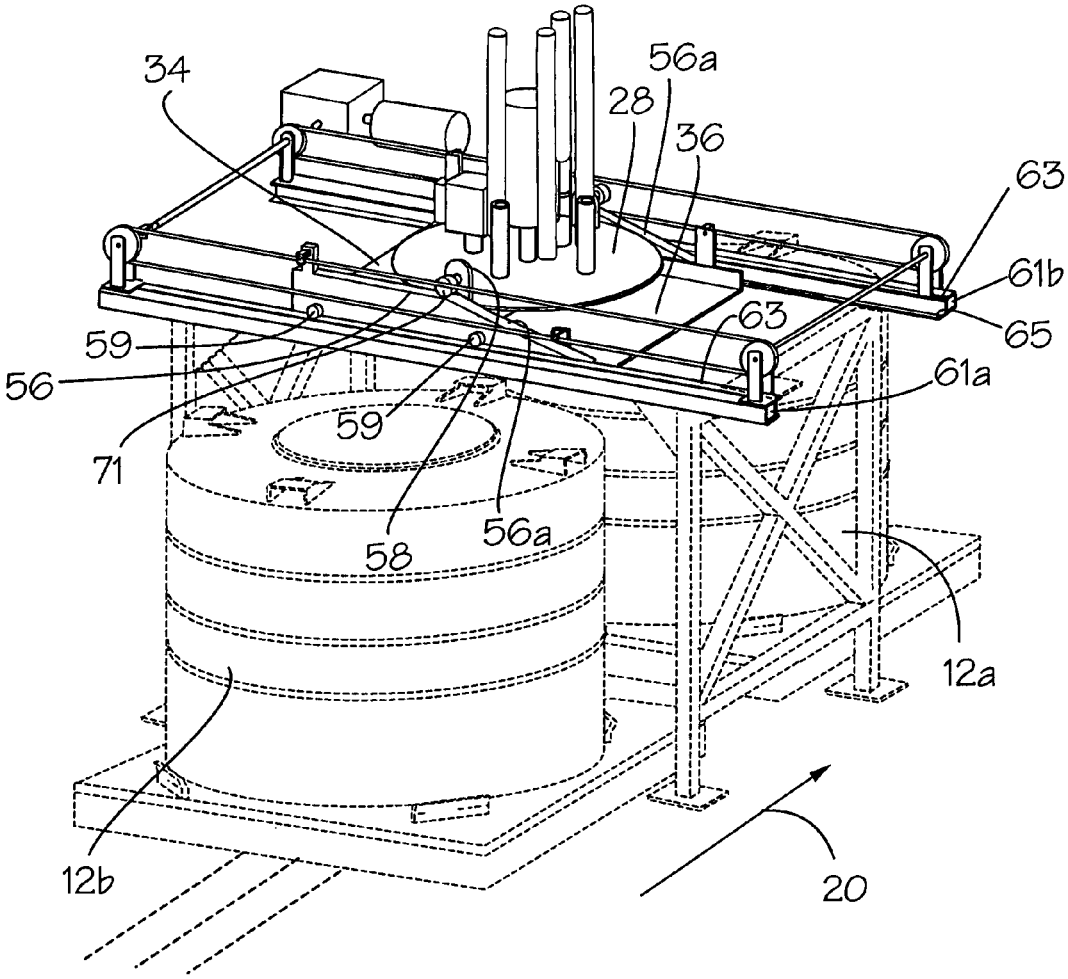
FIG. 6 shows a perspective view of the drip control unit in an extended position and the fill head in a container exchange position according to the present invention; and, FIG. 7 shows a perspective view of the support platform and fill head assembly receiving pallets carrying storage containers according to the present invention.

Drip tray 34 includes a first drive arm 57*a* connected to first drive chain 64*a* in a fixed position so that rotation of the first drive chain causes drip tray 34 to move along support platform 32 between the extended position shown in FIG. 6, and the retracted position shown in FIG. 4.

In a preferred embodiment, drive shaft 62 includes a second drive wheel 51*b* with a second guide wheel 53*b* spaced apart from second drive wheel 51*b* and a second drive chain 64*b* rotatably carried thereon. Drip tray 34 includes a second drive arm 57*b* connected to second drive chain 64*b* disposed on an opposite end of drip tray 34 from first drive arm 57*a* for moving drip tray 34 along support platform 32 in cooperation with first drive chain 64*a*.

Trays 34 and 36 can travel on small rollers 59 along guild rails. As drive shaft 62 rotates in one direction, the drip trays travel toward each other. When drive shaft 62 rotates in the opposite direction, the trays travel away from each other. Support platform 32 includes a pair of guide rails 61*a* and 61*b* being generally parallel and spaced apart from each other for directing movement of the trays along the support platform. Drip tray 34 includes guide rollers 59 carried on lifting arm 56 for running along guide rails 61*a* and 61*b* to promote sliding movement of drip tray 34 along the guide rails.

In a preferred embodiment, secondary catch tray 36 is connected to drive chains 64*a* and 64*b* by drive arms 81*a* and 81*b* and is disposed on an opposite end of support platform 32 from drip tray 34. Secondary catch tray 36 is drawn towards drip tray 34 when fill head 28 is moved to the container exchange position so that drip tray 34 at least partially overlaps with secondary catch tray 36 to retain any drippings from said fill head, as shown in FIG. 6.

Guide rails 61*a* and 61*b* include an upper track 63 and lower track 65, wherein guide rollers 59 carried on lifting arm 56 run along upper track 63, and guide rollers 59 carried on secondary catch tray 36 run along said lower track 65 to promote sliding movement of drip tray 34 and catch tray 36 along guide rails 61*a* and 61*b*.

Figure 5:
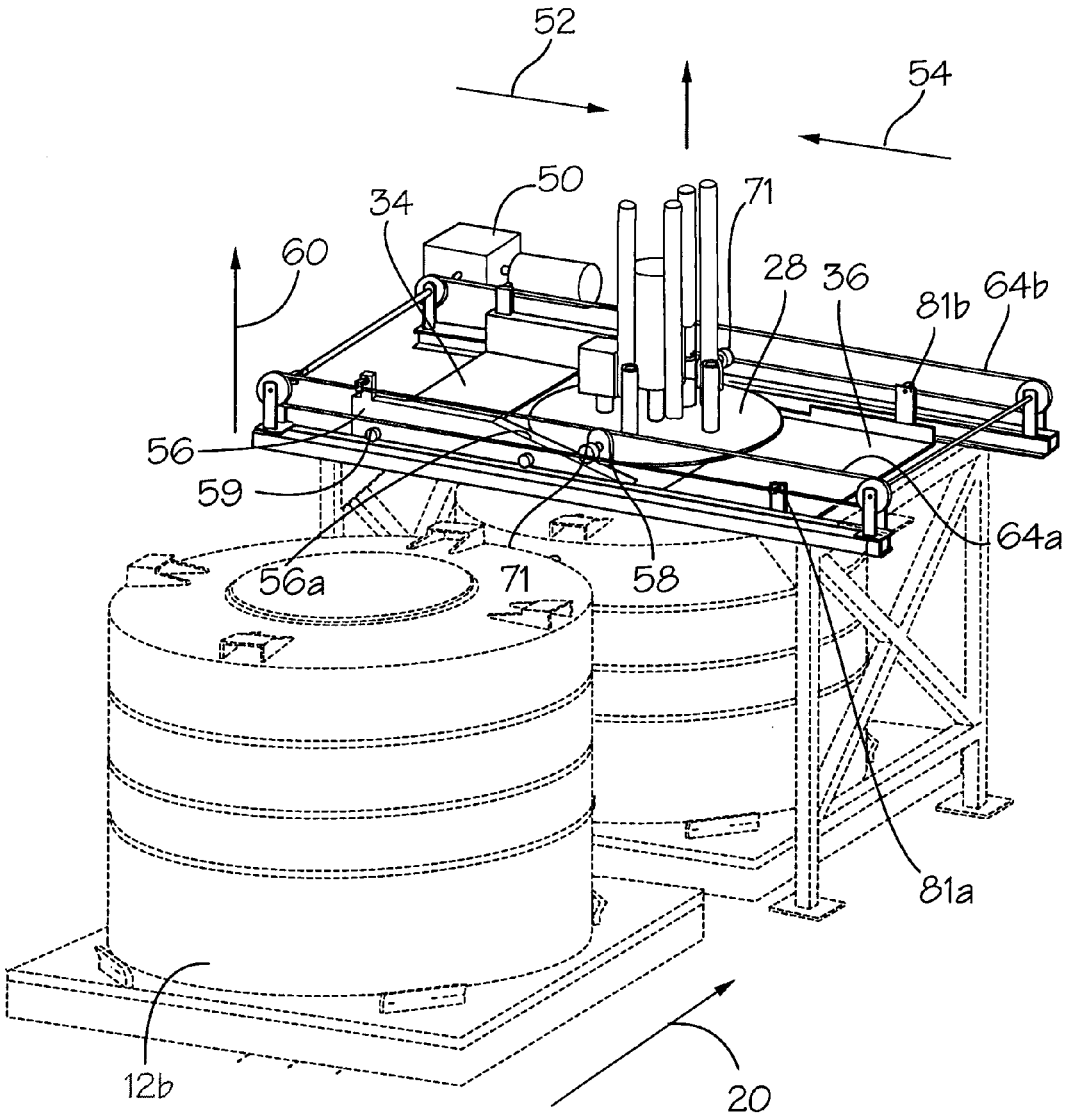
FIG. 5 shows a perspective view of the drip control unit engaging the fill head to withdraw the fill head from the storage container according to the present invention.

Referring to FIG. 5, when the filling process has been completed for container 12*a*, fill head 28 is moved above and away from container 12*a*, so the next container 12*b*, can be positioned under the fill head. To eliminate hands-on operation and reduce an individual's exposure to hazardous materials, drive mechanism 50 begins moving drip tray 34 in a direction shown as 52 and secondary catch tray 36 in a direction shown as 54 simultaneously. When drip tray 34 moves in direction 52, slanted bearing surface 56*a* of lifting arms 56 engages fill head 28 at control arms 58 once drip tray 34 has traveled a sufficient distance so that lifting arms 56 bias control arms 58 upward. When slanted bearing surface 56*a* engages control arms 58, the fill head is moved in a direction shown as 60 as an upward force on the lifting point by the slanted bearing surfaces pushes the fill head upwards. Therefore, the fill head is lifted above and away from the container without hands-on action by an individual operator.

Referring to FIG. 6, the invention is shown in a container exchange position. In this position, drip tray 34 overlaps secondary catch tray 36 so that any drippings from the fill head are caught by the overlapping fill trays. Fill head 28 is in a raised position since control arms 58 are biased upward on slanted bearing surfaces 56*a* holding fill head 28 in the container exchange position. These trays minimize the potential for container contamination dripping waste feed into the loading area once the fill head is disengaged from the container.

When fill head 28 is in the container exchange position, container 12*a* can then be moved away from fill head 28 and container 12*b* can be placed underneath fill head 28.

It should be noted that trays 34 and 36 can be covered with an absorbent pad material across at least a portion of said drip tray extended underneath fill head 28 for capturing drippings to bind any drippings to the trays and allow for easier subsequent removal of any drippings.

The connections between the "in-container" components, such as the dewatering lance and agitator shaft, are made with simple slip-fit connections allowing the fill head to engage and disengage these container components. Hoses external to the fill head can be flexible to allow vertical movement of the fill head between the filling and the container exchange positions. Rigid connections to the fill head such as those that may be needed for dry cement feed may employ a slip-fit connection enclosed within a bellows for containment.

In one embodiment, support platform 32 may also include fill head guides to ensure correct alignment when traveling between the filling and the container exchange positions. The fill head can travel in these guides to help the fill head maintain its position over the current container.

In one embodiment, the fill head is designed to create a positive seal with the container through a chamfered ring to ensure containment of waste and feed during the encapsulation process. In addition, the container may be equipped with an internal splash guard.

Drive mechanism 50 may also include pneumatic power to actuate the drip trays if an electrical connection is not available.

Figure 7:
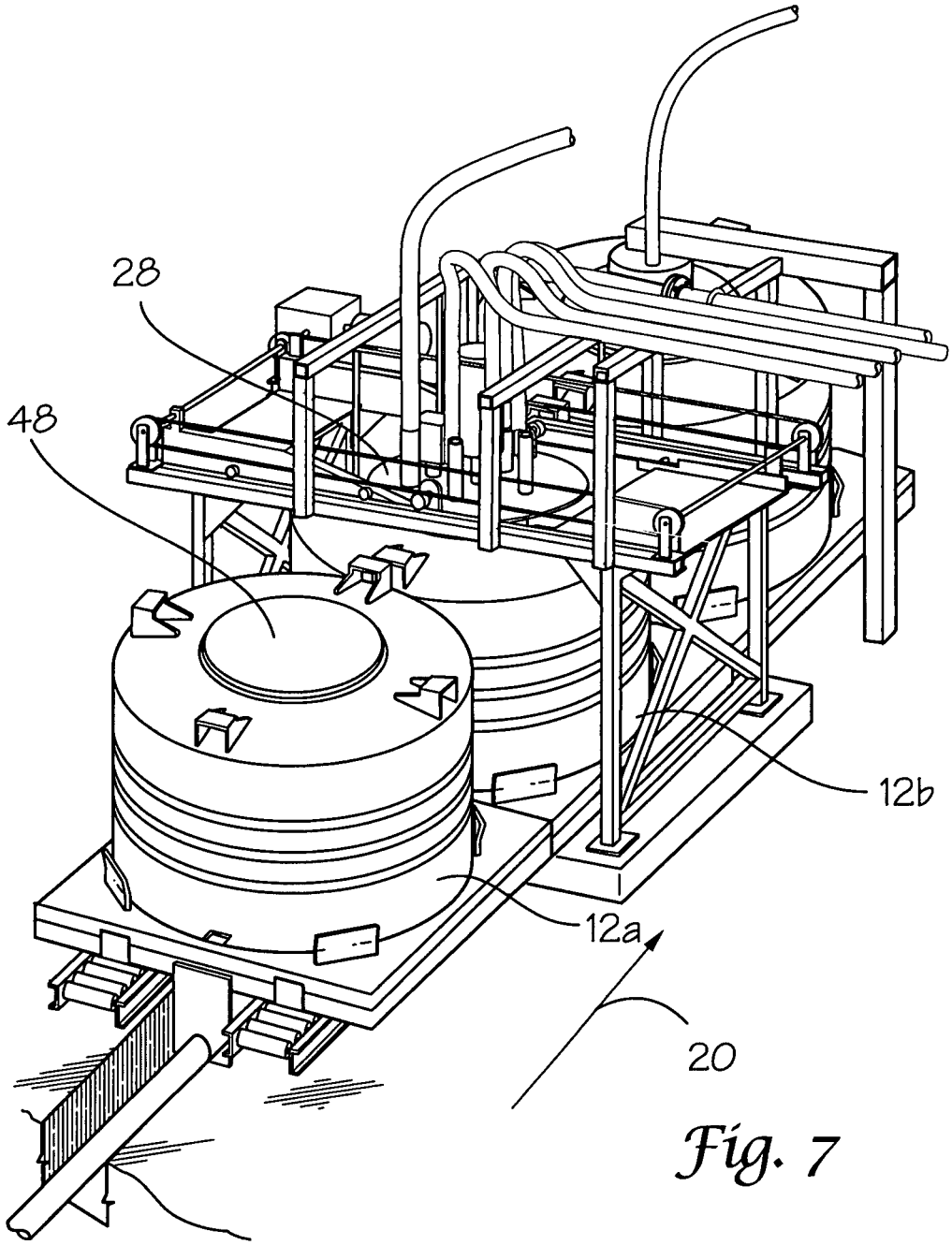

Referring to FIG. 7, container 12*a* is sealed with a lid 48 that can be secured to the container after the waste and other materials are introduced to the container. In the illustrated example, container 12*a* then travels in a direction 20 and container 12*b* travels under fill head 28 for filling.

Therefore, this invention provides a unique design that includes drip trays that automatically engage and disengage the fill head from the container without individual hands-on operation. The connection of the fill head to the container is made automatically and drips, after disengagement of the fill head from the container, are captured in drip trays so that the underside of the fill head is protected and contamination of the container from dripping is minimized.

While a preferred embodiment of the invention has been described using specific terms, such description is for illustrative purposes only, and it is to be understood that changes and variations may be made without departing from the spirit or scope of the following claims.

What is claimed is:

1. An automated fill head assembly for loading hazardous waste into containers, said fill head assembly comprising:

a fill head for depositing hazardous waste materials into a container, wherein said fill head is movable between a filling position seated on the container, and a container exchange position withdrawn from the container;

a control arm carried by said fill head directing movement of said fill head between said filling and exchange positions;

a drip tray movably carried on a support platform adjacent said fill head for extending underneath said fill head to retain drippings of said hazardous waste material from said fill head when in said exchange position; and, a lifting arm carried by said drip tray engaging said control arm, wherein said lifting arm moves relative to the control arm and biases said control arm to raise said fill head from said filling position to said exchange position when said drip tray is extended underneath said fill head so that as the fill head is withdrawn from the container any dripping hazardous waste is captured by said drip tray.

2. The fill head assembly of claim 1 wherein said lifting arm includes a slanted bearing surface for engaging said control arm in sliding engagement to direct said control arm upward as said drip tray is extended underneath said fill head.

3. The fill head assembly of claim 2 wherein said control arm includes a roller for engaging said slanted bearing surface to promote sliding engagement between said lifting arm and said control arm.

4. The fill head assembly of claim 1 wherein said drip tray includes an absorbent pad disposed across at least a portion of said drip tray extended underneath said fill head for capturing drippings.

5. The fill head assembly of claim 1 including a drive mechanism carried on said support platform being operatively connected to said drip tray for moving said drip tray along said support platform between an extended position underneath said fill head when said fill head is moved to said exchange position, and a retracted position withdrawn from said fill head when said fill head is in said filling position.

6. The fill head assembly of claim 5 wherein said drive mechanism includes a drive motor rotationally connected to a drive shaft with a first drive wheel rotatably connected to said drive shaft, and a first guide wheel spaced apart from said first drive wheel on said support platform with a first drive chain rotatably carried by said first drive wheel and said first guide wheel.

7. The fill head assembly of claim 6 wherein said drip tray includes a first drive arm connected to said first drive chain in a fixed position so that rotation of said first drive chain causes said drip tray to move along said support platform between said extended and retracted positions.

8. The fill head assembly of claim 7 wherein said drive shaft including a second drive wheel with a second guide wheel spaced apart from said second drive wheel and a second drive chain rotatably carried thereon, wherein said drip tray includes a second drive arm connected to said second drive chain disposed on an opposite end of said drip tray from said first drive arm for moving said drip tray along said support platform in cooperation with said first drive chain.

9. The fill head assembly of claim 8 wherein said support platform includes a pair of guide rails being generally parallel and spaced apart from each other for directing movement of said drip tray along said support platform.

10. The fill head assembly of claim 9 wherein said drip tray includes guide rollers carried on said lifting arm for running along guide rails to promote sliding movement of said drip tray along said guide rails.

11. The fill head assembly of claim 10 including a secondary catch tray connected to said drive mechanism being disposed on an opposite end of said support platform from said drip tray, wherein said secondary catch tray is drawn towards said drip tray when said fill head is moved to said exchange position so that said drip tray at least partially overlaps with said secondary catch tray to retain any drippings from said fill head.

12. The fill head assembly of claim 11 wherein said guide rails include an upper track and lower track, wherein said guide rollers carried on said lifting arm run along said upper track, and secondary catch tray includes guide rollers running along said lower track to promote sliding movement of said drip tray and catch tray along said guide rails.

13. An automated fill head assembly for loading hazardous waste into containers, said fill head assembly comprising:

a fill head for depositing hazardous waste materials into a container, wherein said fill head is movable between a filling position seated on the container, and a container exchange position withdrawn from the container;

a control arm carried by said fill head directing movement of said fill head between said filling and exchange positions; and, a drip control unit carried on a support platform adjacent said fill head, the drip control unit being operatively associated with said control arm to move relative to the control arm and thereby actuate movement of said control arm to move said fill head between said filling and exchange positions so that as said fill head is withdrawn from the container to said exchange position any dripping hazardous waste is captured;

wherein said drip control unit includes a drip tray slidably carried on said support platform for extending underneath said fill head to retain drippings of said hazardous waste material from said fill head; and wherein said drip tray includes a lifting arm carried by said drip tray for engaging said control arm to raise said fill head from said filling position to said exchange position when said drip tray is extended underneath said fill head so that as the fill head is withdrawn from the container any dripping hazardous waste is captured by said drip tray.

14. The fill head assembly of claim 13 wherein said lifting arm includes a slanted bearing surface for engaging said control arm in sliding engagement to direct said control arm upward as said drip tray is extended underneath said fill head.

15. The fill head assembly of claim 14 wherein said support platform includes a pair of guide rails being generally parallel and spaced apart from each other for directing movement of said drip trap along said support platform.

16. The fill head assembly of claim 15 wherein said drip tray includes guide rollers carried on said lifting arm for running along guide rails to promote sliding movement of said drip tray along said guide rails.

17. The fill head assembly of claim 16 including a secondary catch tray disposed on an opposite end of said support platform from said drip tray, wherein said secondary catch tray is drawn towards said drip tray when said fill head is moved to said exchange position so that said drip tray at least partially overlaps with said secondary catch tray to retain any drippings from said fill head.

18. A method for controlling drippings from a fill head for hazardous waste materials comprising the steps of:

lowering said fill head into a filling position seated on a container for depositing hazardous waste materials into the container;

loading hazardous waste materials into said container;

providing a drip tray adjacent said fill head carrying a lifting arm for engaging said fill head;

moving said drip tray and said lifting arm towards said fill head to engage said lifting arm with a control arm carried on said fill head so that said lifting arm biases said control arm upwardly and raises said fill head from said filling position on said container to a container exchange position withdrawn from said container; and, extending said drip tray underneath said fill head as said lifting arm raises said fill head to said exchange position to retain any hazardous waste materials dripping from said fill head.

* * * * *